US006267614B1

(12) United States Patent
Good et al.

(10) Patent No.: US 6,267,614 B1
(45) Date of Patent: Jul. 31, 2001

(54) LOW PROFILE/HIGH LEVERAGE ELECTRONIC COMPUTER BOOK LATCHING SYSTEM

(75) Inventors: Michael Scott Good, Byron; Max John Christopher Koschmeder, Oronoco; Jerry Richard Rasmussen, Rochester, all of MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/497,449

(22) Filed: Feb. 3, 2000

(51) Int. Cl.[7] ..... H01R 13/62
(52) U.S. Cl. ..... 439/327; 439/160
(58) Field of Search ..... 439/327, 325, 439/160, 157

(56) References Cited

U.S. PATENT DOCUMENTS 5,414,594 * 5/1995 Hristake ..... 439/325
5,793,614 * 8/1998 Tollbom ..... 439/325
6,045,385 * 4/2000 Kane ..... 439/327

* cited by examiner

*Primary Examiner*—Brian Sircus
*Assistant Examiner*—Javaid Nasri
(74) *Attorney, Agent, or Firm*—Laurence R. Letson

(57) ABSTRACT

A lever and latching arrangement having a pair of camming surfaces disposed on one end thereof is attached to one end of a tailstock member of an electronic memory book or central electronic complex book of a computer. This lever arrangement, as rotated about a pivot axis, engages one of the camming surfaces with a portion of the computer frame; the mechanical advantage of the lever system overcomes the large forces required to connect or disconnect the electronic book from the computer connectors. The pivot axis is positioned between the side rail of the book and the computer frame and between the tailstock and the connectors of the book to afford a low profile relative to the tailstock, permitting a more efficient use of available volumetric space within the computer. On the end of the lever distal from the pivot axis, the lever supports a latch which is insertable into a latch-retaining opening in the tailstock of the book, providing the capability to latch the lever in the installed position while not requiring any additional height of the lever structure.

9 Claims, 4 Drawing Sheets

LOW PROFILE/HIGH LEVERAGE ELECTRONIC COMPUTER BOOK LATCHING SYSTEM

FIELD OF THE INVENTION

This invention relates to mechanisms for assisting in the electrical connection of memory, central electronic complex, and other similar electronic books to the electrical connector of a computer and, more specifically, to this high leverage insertion lever and latching system necessary on an electronic book frame and connector in order to exert the large forces required to properly connect books with computer connectors.

BACKGROUND OF THE INVENTION

Computers and servers now are designed with very large internal memories requiring very large numbers of memory modules. Each memory module or memory chip requires a plurality of connections, both to and through the circuit board onto which it is mounted and to the circuit board connectors, which then may be connected to mating connectors as part of the host computer. Similarly, a large and complex central electronic portion of the computer is required to control, address and efficiently utilize the large internal memories. The interconnection of the circuit board connectors on the memory panels and central electronic complex panels to the computer connectors effectively connects the memory or other electronic modules to the circuitry of the host computer.

In order to make a computer easily maintainable and repairable, as necessary, the memory modules and the components of the central electronic system are mounted on a plurality of removable and replaceable electronic circuit boards. These electronic circuit boards are mounted within rigid frames which permit the circuit boards and associated circuit board connectors to be removed from the computer and changed out with a replacement assembly providing protection from the high level forces necessary for insertion and removal. The completed assembly of the memory modules, circuit board, frame and connectors are commonly collectively referred to as a "book." Additionally a central electronic complex for the computer may be made into a "book" for the same reasons.

Each book must be easily removable and replaceable with respect to the computer framework or connections to the electronics of the computer. Removal and re-connection of books during operation of the computer or server is referred to as "hot plugging." As it is common for computers to be operational at all times, maintenance and repair must be accomplished to whatever extent possible while the computer is operating, thus requiring hot plugging. Thus, the installation and removal of the book must be accomplished to insure minimal, if any, disruption to the continued computer operation.

With a large memory capacity or a large number of electronic components necessary for a central electronic complex assembled as a book, the number of connections required between the book and computer circuits can and does become quite large. For example, a typical connector may have 1112 pin-in-socket interfaces. More or fewer such connections may be incorporated as dictated by the type and the number of chips or electronic components on the electronic circuit board of the book.

A typical book of memory or central electronic complex book may require connection forces of up to 190 pounds or disconnection forces of 60 pounds or more, force levels which generally are not manageable by service or assembly personnel without an additional apparatus to assist and evenly apply the connection or disconnection forces to the book frame. This connection or disconnection force is the cumulative force made up of the combined frictional resistance forces of connection or disconnection for each individual pin and socket connection. Even and proper distribution of the connection and disconnection forces to the book frame is necessary to prevent any potential bending or damaging of the pins and/or misconnection of any connector on the electronic circuit board of the book.

A prior art lever and latching system which has been used to aid in the insertion, connection, disconnection and removal of a electronic book in a computer is illustrated in FIG. 1. The lever and latching system in FIG. 1 is such that the maximum utilization of the space within the computer, by maximization of the dimensions of the circuit board within a particular book, has been compromised both by the volume of space required for the latching and retention apparatus as well as the resulting unusable space between the latches. The disposition of the latches on the exposed, external planar surface 12 of the tailstock 10 by the positioning of bracket 14 and pivot 18, as illustrated, consumes excessive space. Additionally, the disposition of latch 22 to engage the latching surface 32 of bracket 14 further requires the latch arms 16 to be displaced significantly from tailstock 10 in order to accommodate the latch structure and permit manual access to the release member 28. With the consumption of available space by the latch arm 16, the remaining space is unduly limited within the computer frame for the book including the electronic circuit board and the electronic modules.

OBJECTS OF THE INVENTION

It is an object of the invention to ease the insertion and connection of electronic books into a computer frame.

It is another object of the invention to easily overcome the large cumulative frictional forces encountered whenever connecting or disconnecting large numbers of pin-in-socket connectors in a computer.

It is a further object of the invention to latch and retain an electronic book within a computer whenever connected to the computer.

It is still another object of the intention to reduce the required space for the electronic book installed within the host computer.

SUMMARY OF THE INVENTION

An electronic book, such as a memory book or a central electronic complex book and which is intended for insertion into and incorporation into a computer as a subassembly, is provided with a pair of levers which engage the frame of the computer at ends closely spaced to the fulcrums of the levers, thereby resulting in a significant mechanical advantage. The levers and their mechanical advantage are employable to connect or disconnect the electrical connectors of the electronic book with and from connectors of the computer both with much lower manual forces and evenly applied connection forces.

The levers or latch arms are pivoted about axes which are disposed intermediate the extended plane of the book tailstock to which the levers are mounted and the extended plane of the connector housing interface surface on the electronic circuit board of the book. On ends distal from the pivot axes, the levers carry latches which engage the tailstock to hold the levers in a desired latched position, thus insuring retention of the book in a desired position relative to the computer's connectors. The latches are extensions affording a low profile to the latch arm or levers. The latch arms are further formed to provide an end surface which, once latched, reside on the outer surface of a flange of the computer frame giving mechanical advantage to the force and movement required for disconnection of and removal of the book from the computer connector. With forces of up to 190 pounds required to connect an electronic book to the computer connector, the mechanical advantage required must be large while the displacement provided by a latch arm movement must be adequate to fully engage the connectors.

The design of the latch arm and latch on the distal end of the latch arm and its incorporation into the book assembly affords a low profile which permits the design of a computer with either a larger electronic book with an increased electronic module carrying capacity to be used within a given frame size or a smaller frame to accept a predetermined sized electronic book.

While sufficiently rigid to transmit the connection/disconnection forces to the electronic book, the latch arms also must be resilient to the degree permitting a final deflection to latch once the electronic book is fully plugged and to maintain a loading on the connectors.

A better and more complete understanding of the invention may be derived from the attached drawings and the detailed description of the invention to follow.

DETAILED DESCRIPTION OF THE PREFERRED EMBODIMENT OF THE BEST MODE FOR IMPLEMENTING THE INVENTION AS CONTEMPLATED BY THE INVENTORS

Figure 1:
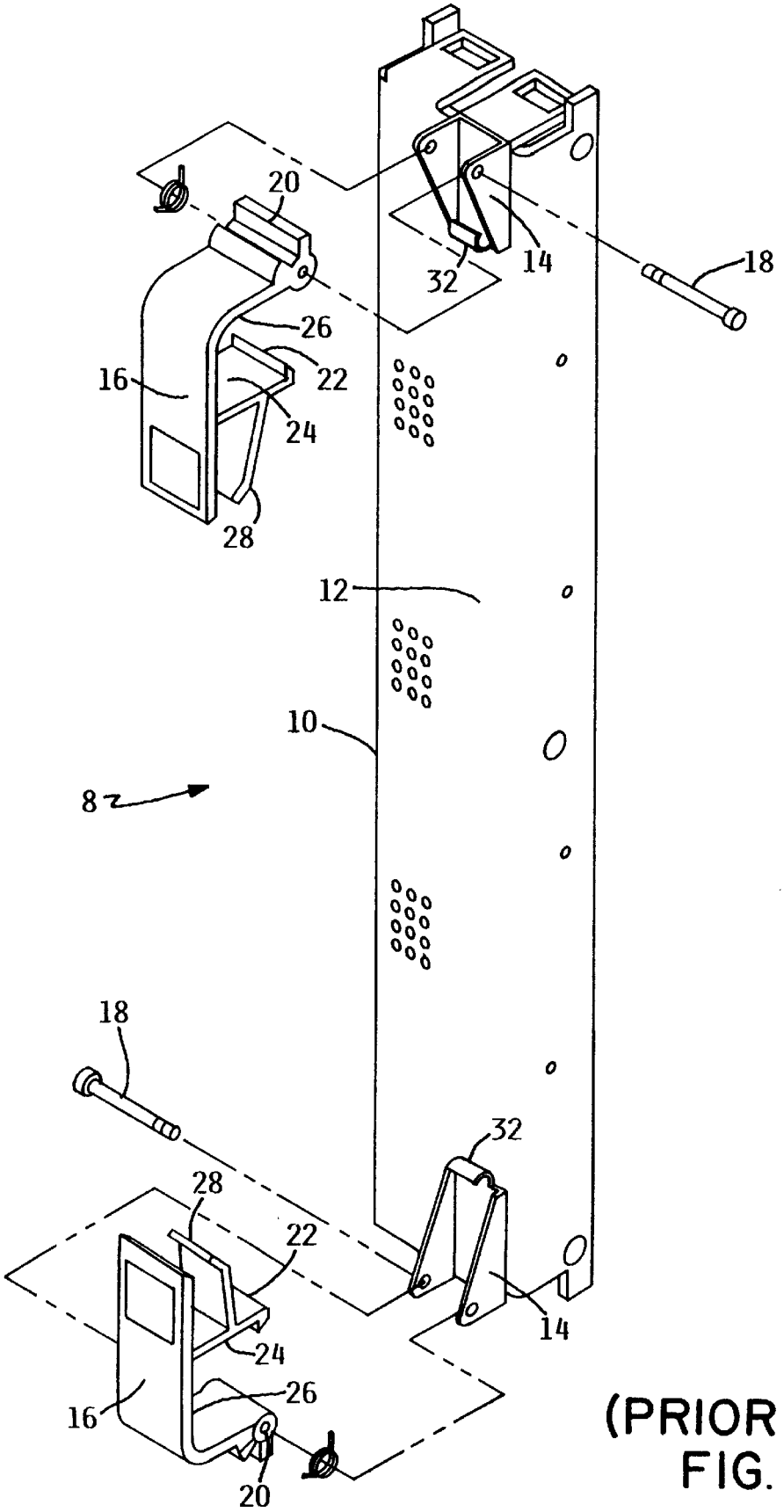
(PRIOR ART) FIG. 1
FIG. 1 shows an exploded view of a prior art latching system for inserting and latching books within a computer, which not only consumes excessive space but limits efficient space utilization as well.

FIG. 1 illustrates the prior art wherein the tailstock 10 of an electronic book, such as a memory book or a central electronic complex book, is illustrated in a vertical orientation The remainder of the book frame, a circuit board, and electronic connectors are not shown in FIG. 1. Tailstock 10 is a book frame member having a generally exposed planar surface 12 which supports latch pivot brackets 14. The latch pivot brackets 14 are attached to the tailstock 10 on the exposed planar surface 12 by screws, rivets, welding or other conventional attaching techniques (not shown).

The latch pivot brackets 14, each disposed proximate opposite ends of the tailstock 10, each support a latch arm 16. The latch arm 16 is pivotally supported on a latch pin 18 and is movable around the pivot pin 18 to engage the camming lip 20 of latch arm 16 with a computer frame member (not shown in FIG. 1 but the same as or similar to flange 82 of FIG. 2).

Again referring to FIG. 1, the latch arm 16 further is provided with a latch member 22 supported on a slightly deflectable or flexible member 24 extending from the back or underside 26 of latch arm 16. The latch 22 is manipulated by a finger pulling latch release 28 toward latch arm 16 thereby deflecting latch 22 from its normal at-rest position or from its position biased against a latching or engaging surface 32 formed into the end of the latch pivot bracket 14. This pulling action on latch release 28 releases latch 22 from the latching surface 32 of pivot bracket 14, thereby releasing latch arm 16 for pivotal movement about pivot pin 18.

In the exploded presentation of FIG. 1, the tailstock assembly 8 is shown in a vertical orientation but may be positioned in a horizontal orientation permitting a drop-in installation of the book rather than slide-in installation, if preferred. A drop-in installation may be preferable to minimize the need for substantial guide and support structures in the computer frame. The weight of the electronic book, typically four to eight pounds, does not need to be supported or held in a cantilevered fashion during alignment and installation in a drop-in orientation with the tailstock 10 horizontally oriented.

Figure 2:
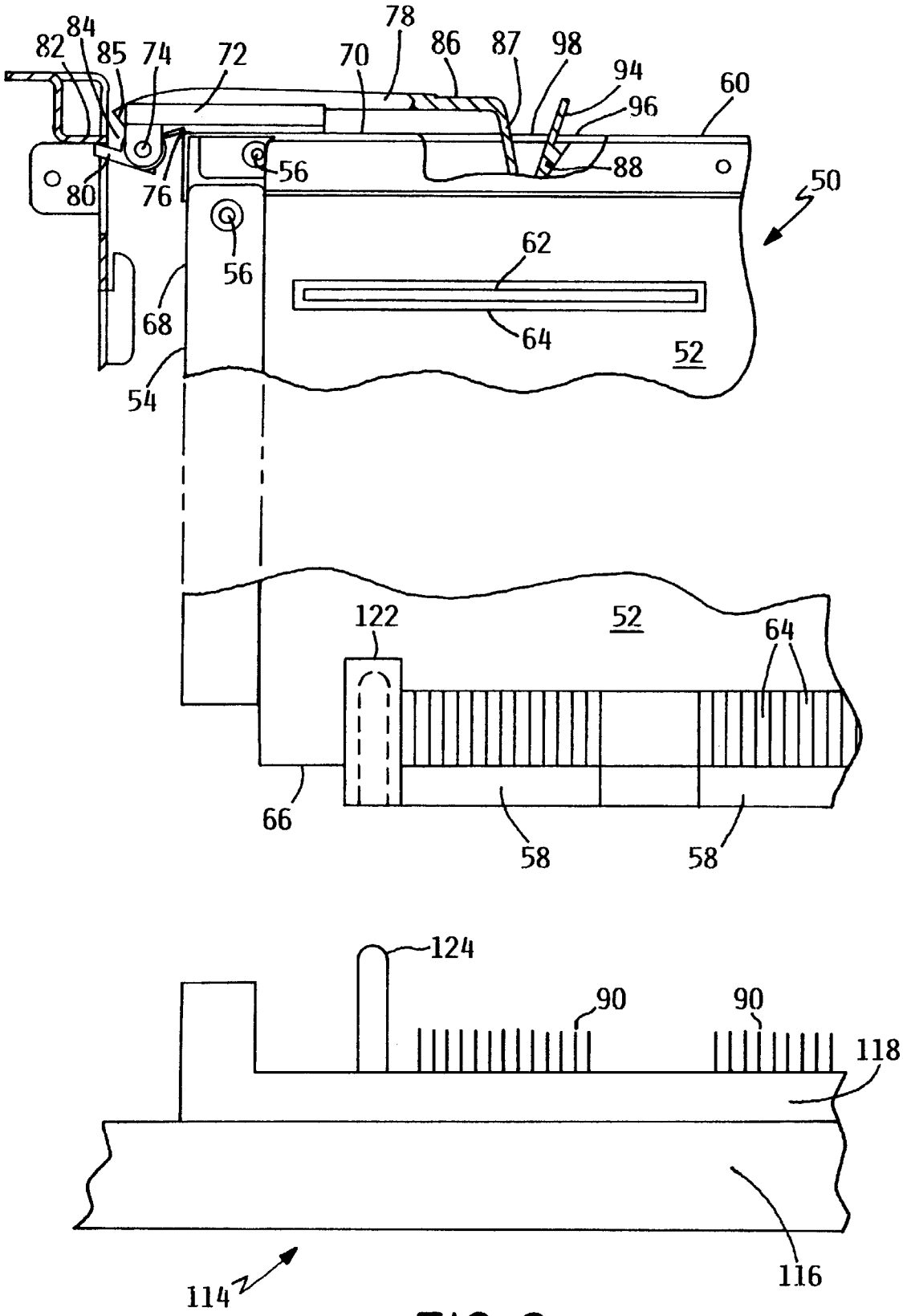
FIG. 2 illustrates a portion of an electronic book, book guide, and book frame incorporating the latching and retention system of the present invention.
Figure 3:
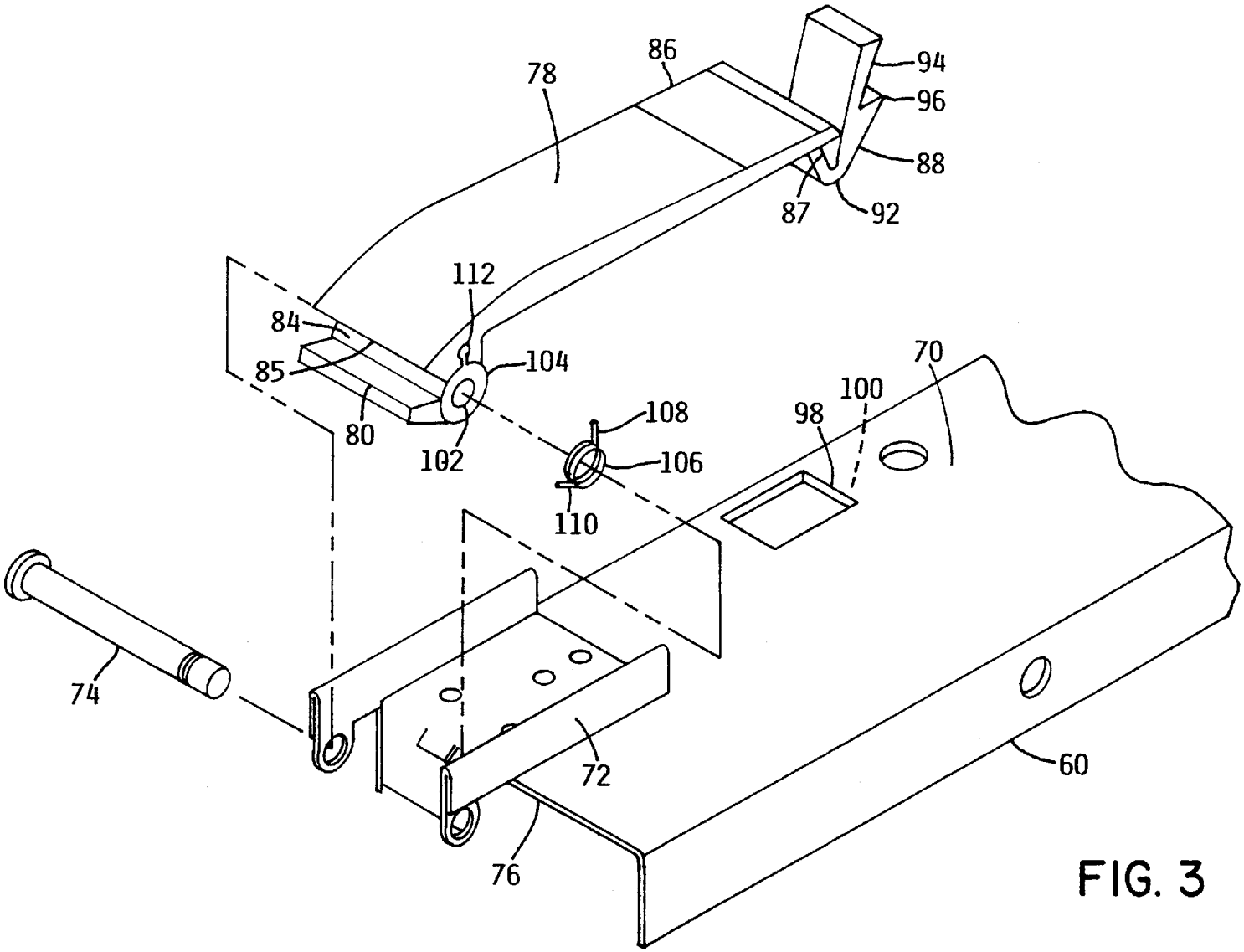
FIGS. 3 and 4 illustrate partially-exploded views of the latching system of the present invention as attached to tailstocks of different type books.
Figure 4:
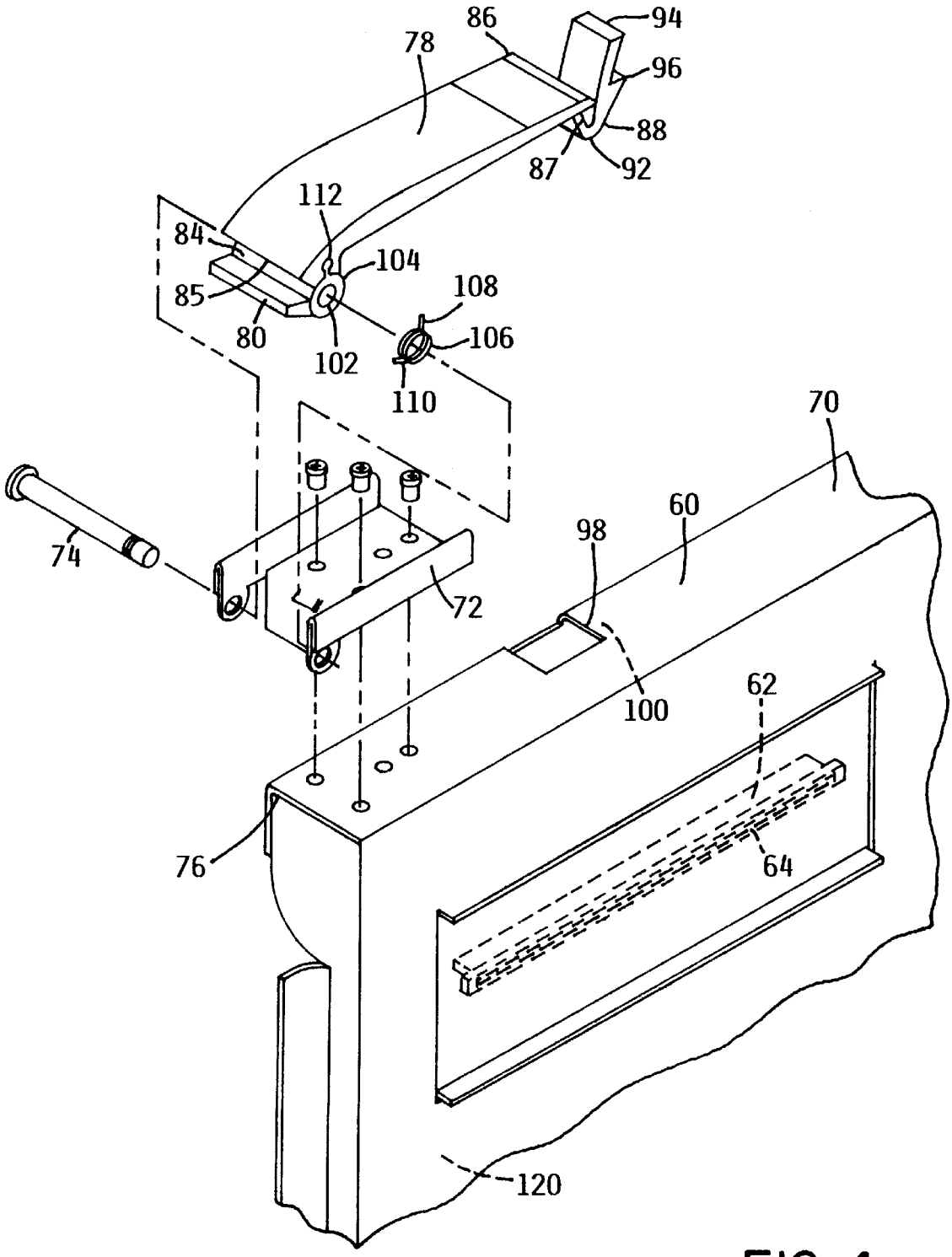

Referring now to FIGS. 2, 3 and 4 and initially to FIG. 2, an electronic book 50 incorporating the present invention is illustrated with portions broken away to permit observation of some parts otherwise hidden from view. Electronic book 50 is shown with an electronic circuit board 52 attached to frame 54 of electronic book 50 by screws 56 or other conventional fasteners. Circuit board 52 may be a memory circuit board, a central electronic complex circuit board or any other suitable type circuit board. The book frame 54 includes a rigid metal plate or card stiffener plate 120 in FIG. 4, which extends across the width and height of the electronic book 50, with the edges of the plate 120 formed to make up or be attached to the electronic book frame 54. Electronic book frame 54 is so constructed to result in a very rigid structure that supports circuit board 52 and the ganged electrical connectors 58 attached and supported on one edge 66 of the electronic circuit board 52 opposite tailstock 60.

In an electronic book 50, which includes a large number of the memory modules 62, memory modules 62 are connected by connectors 64 or sockets 64 to the circuit board 52. Depending upon the size and capacity of the memory modules 62, (one of which is illustrated in FIGS. 2 and 4), a typical book may include from thirty-two large memory modules 62 up to a much larger number of smaller capacity modules. In either instance, connectors 58, 118 which conduct signals for addressing and accessing the memory modules 62 of electronic book 50 are positioned and connected along one edge 66 of electronic circuit board 52 in the form of connectors 58.

Connectors 58 extend substantially along the entire length of edge 66 of circuit board 52. Connectors 58 may incorporate more than 1,000 individual socket connections for mating with a like number of connector pins 90 which are part of the computer 114 circuitry.

Connectors 118 and pins 90 are disposed on a frame portion 116 of computer 114. The frame portion 116 of computer 114 also supports a plurality of alignment guide pins 124 which align with and enter guide pin sockets 122, ensuring that the electrical connector pins 90 are aligned with their respective connector sockets 64 in connectors 58.

Attached to the exterior planar surface 70 of tailstock 60 and extended outwardly from ends 76 are pivot brackets 72. The pivot brackets 72 are attached proximate the ends 76 of the tailstock 60 to engage computer frame flange 82 and latch arm 78 to provide balanced forces for connection and disconnection of the electronic book 50. In FIGS. 2, 3, and 4, only one lever and latching assembly is illustrated; however, one such assembly is incorporated on each of two adjacent comers of an electronic book 50.

The attachment of pivot brackets 72 to tailstock 60 may be by any conventional means such as screws, rivets or welding (not shown). The attachment of pivot bracket 72 must sufficiently resist large forces that attempt to separate the pivot bracket 72 from tailstock 60 whenever electronic book 50 is being installed and connected. A pivot pin 74 is supported by the pivot bracket 72 and disposed so that the axis of pivot pin 74 is substantially orthogonal to the plane of electronic circuit board 52. Pivot pin 74 is further located proximate the side edges 68 of book frame 54 such that the pivot axis of pivot pin 74 is not located farther from edge 66 of circuit board 52 than the tailstock 60. This location is important to render the latch arm system a low profile system and conserve space within computer 114. With the space conserved, it may be used to expand the Size of the electronic circuit board 52, permitting further expansion of the capabilities of the electrical circuit board 52

The end 80 of latch arm 78 is pivoted about pivot pin 74 and engages computer frame flanges 82 and, as rotated, causes the forcing of pivot 74 farther into the frame of the receiving computer. As pivot pin 74 is forced farther toward the frame portion 116 of the computer 114, the connectors 58 are forced onto the mating connector pins 90 to the maximum extent possible, completing the electrical connections between electronic book 50 and the computer connector 118.

The structure of latch arm 78 and the related latch bracket 72 are illustrated in FIGS. 3 and 4. Latch arm 78 is formed with a groove 84 in the material forming the portion of latch arm 78 encircling pivot 74. Groove 84 is dimensioned and disposed to accept computer frame flange 82, as illustrated in FIG. 2. Whenever flange 82 resides in groove 84, end 80 will be disposed behind flange 82 and, upon rotation of the latch arm 78 toward the tailstock 60, can engage flange 82. Surface 85 formed by groove 84 can engage the front of flange 82 once latch arm 78 is rotated away from the tailstock 60.

The fully plugged height of the electronic book 50 or distance between the computer connector 118 and the tailstock 60 of the electronic book 50 may vary from one book 50 to the next due to manufacturing tolerances and the depth to which the pins 90 mate with the sockets 64 in the connectors 58. Accordingly, the fully plugged lever position requires a degree of flexibility in the latch arm 78 to permit latching whenever the latch arm 78 reaches its limit of rotational travel and to provide a constant preload on the connectors 58, 118 as well as a loading of latch surface 96 of latch structure 88 agains latching surface 100. The "V"-shaped latch structure 88 is supported by distal end 86 of latch arm 78. Depending leg 87 of latch structure 88 is formed thick enough so as to be substantially rigid with the trough portion 92 thin enough to locally flex. Release leg 94 of latch structure 88 carries a latch surface 96 and is similarly rigid. Trough portion 92 effectively acts as a limited hinge or flexure and provides a restore force to force latch/release leg 94 against the edge of aperture 98 in tailstock 60.

Aperture 98 is disposed to accept the entry of latch structure 88 and further provides a latching surface 100 which engages latch surface 96 of latch structure 88 whenever latch structure 88 is inserted into aperture 98 and forced sufficiently to pass latch surface 96 beyond latching surface 100.

Latch arm 78 is further formed with a circular recess 102 circumscribing fulcrum hole 104 through which pivot pin 74 passes. Circular recess 102 accepts coiled torsion spring 106 surrounding pin 74. One end 108 of the coiled torsion spring 106 is trapped in recess 112 within latch arm 78, and the opposite end 110 of coil torsion spring 106 engages latch bracket 72 or alternatively engages tailstock 60 to provide an opening bias to latch arm 78 insuring engagement of latch surface 96 with latching surface 100.

The low profile of the latch arm 78 and the location of the pivot axis of pivot pin 74 permits implementation of a lever actuator and a latching arrangement in a small space; moreover, they permit the implementation of the latch arm 78 on a plurality of different styles or type electronic books 50 or insertable electronic circuit boards 52 and their respective tailstocks 60 and frames 54 or card stiffener plates 120.

In order to install the electronic book 50 or other electronic circuit board 52 with a frame 54 and tailstock 60, connectors 58 are first inserted into the computer 114. Particularly in a slide-in installation, the electronic book 50 is too heavy to be conveniently supported and guided by hand with the accuracy required. Guide sockets 122 (as shown in FIG. 4) are engaged with guide pins 124. The guide sockets 122 precisely align the connectors 58 with a mating connector 118 in the computer 114. The latch arm 78, once unlatched, presents surface 85 to flange 82 and end 80 of latch arm 78 passes flange 82. Upon rotation of latch arm 78 about pivot pin 74, the end 80 of latch arm 78 rotates with flange 82 in groove 84 until end 80 engages flange 82. Thereafter, any further rotation of the latch arms 78 toward the tailstock 60 will force pivot pin 74 and latch bracket 72 toward connectors 118 of the computer 114 and seat the electronic circuit board connectors 58 onto the mating connector pins 90. The latch arms 78 then are latched by pushing latch surface 96 past latching surface 100 on tailstock 60.

To remove the electronic book 50 from connection with the computer 114, latch release leg 94 is manually displaced toward pivot pin 74, flexing trough portion 92 and latch surface 96 is disengaged from latching surface 100. Latch arm 78, under the influence of the spring 106, rotates about pivot pin 74 until surface 85 engages flange 82. Thereafter, the latch arm 78 may be further manually rotated to force its surface 85 against flange 82 and cam the tailstock 60 and the attached electronic circuit board 52 and connectors 5 away from the mating connectors 118, disconnecting the electronic circuit board 52 from the computer 114.

The large frictional resistance forces generated by several hundred pin-in-socket engagements in the connectors 58, 118 are overcome by the mechanical action and the mechanical advantage of the latch arm 78 transmitting the manual force exerted thereon to the pivot pin 74 to install electronic book 50 into or extract electronic book 50 from the computer 114.

Thus, a relatively low level force is required to install or remove a memory or central electronic complex book into or from the computer and this not only insures that fragile elements and connectors are not damaged, but also that a more uniform force is exerted to make or disconnect the several hundred connections without bending or damaging the pins of the computer connector.

One of ordinary skill in the art will recognize that various minor modifications may be made to the invention without removing the resulting device from the scope of protection afforded by the attached claims which define the scope for protection of this invention.

What is claimed is:

1. A computer comprising:

a frame;

a book comprising a book frame, an electronic circuit board supporting a plurality of electronic devices mounted on said electronic circuit board, said book frame supporting said electronic circuit board, a plurality of electrical connectors disposed on said book proximate a first edge of said circuit board and guiding members disposed relative o said connectors for guiding said plurality of electrical connectors into engagement with mating connectors said computer;

said book frame having a substantially exposed planar surface at one edge of said book frame;

said book frame supporting a pair of pivots, said pivots disposed substantially perpendicular to a plane defined by said electronic circuit board and intermediate extensions said substantially exposed surface and a spaced apart said first edge of said circuit board, and each of said pivots supporting a latch arm, one end of each said latch forming an extension for engaging a flange of said computer;

said substantially exposed planar surface forming at least an aperture therein disposed proximate a second end of each of said latch arms;

said second end of each said latch arms forming and supporting a deflectable latch engageable with an edge of said aperture in said book frame.

2. The computer of claim 1 wherein each of said latch arms forms an engaging surface engageable with said flange in a manner to exert a force against said flange, whereby pivotal movements of said latch arms to move said latch away from said book frame act to pull said book frame from a connected position in said computer.

3. The computer of claim 2 wherein said latch comprises a displaceable member, said displaceable member constrained for displacement in a pivoting motion toward and away from said pivot.

4. The computer of claim 3 wherein said one end of each of said latch arms comprises a groove formed to accept a portion of said flange, said groove forming said extension for engaging said flange.

5. The computer of claim 4 wherein a longitudinal axis of said groove is disposed parallel to an axis about which said latch arm pivots.

6. The computer of claim 5 wherein said latch arm is resiliently biased about said pivot to a position for insertion of said book into said computer.

7. The computer of claim 6 wherein said bias is provided by a spring.

8. The computer of claim 3 wherein said book frame further comprises a latching surface and said deflectable member comprises a latch surface thereon oriented to engage said latching surface on said book frame.

9. The computer of claim 3 wherein said latch arm provides a resilient bias to said latch for preserving contact between said latch surface and said latching surface of said book frame.

* * * * *

UNITED STATES PATENT AND TRADEMARK OFFICE

CERTIFICATE OF CORRECTION

PATENT NO. : 6,267,614 B1
APPLICATION NO. : 09/497449
DATED : July 31, 2001
INVENTOR(S) : Michael Scott Good et al.

It is certified that error appears in the above-identified patent and that said Letters Patent is hereby corrected as shown below:

Claim 1, Col. 7, Line 21, "latch forming" should be --latch arm forming--.

Signed and Sealed this

Second Day of January, 2007

JON W. DUDAS
*Director of the United States Patent and Trademark Office*